US007775626B2

(12) United States Patent
Taga et al.

(10) Patent No.: US 7,775,626 B2
(45) Date of Patent: Aug. 17, 2010

(54) CLEANING DEVICE, INKJET PRINTER, AND AN INKJET PRINTER CLEANING METHOD

(75) Inventors: Susumu Taga, Shiojiri (JP); Toshiaki Koike, Shiojiri (JP); Junichi Arai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 488 days.

(21) Appl. No.: 11/504,397

(22) Filed: Aug. 15, 2006

(65) Prior Publication Data

US 2007/0035574 A1 Feb. 15, 2007

(30) Foreign Application Priority Data

Aug. 15, 2005 (JP) ..... 2005-235245

(51) Int. Cl.
*B41J 2/165* (2006.01)

(52) U.S. Cl. ..... 347/30; 347/22; 347/23

(58) Field of Classification Search ..... 347/23, 347/30, 33; 358/1.13
See application file for complete search history.

(56) References Cited

U.S. PATENT DOCUMENTS

| | | | | |
|---|---|---|---|---|
| 5,389,961 | A * | 2/1995 | Takagi | 347/29 |
| 5,847,726 | A * | 12/1998 | Hori | 347/23 |
| 6,176,564 | B1 | 1/2001 | Katayama | |
| 6,318,834 | B1 * | 11/2001 | Otsuka et al. | 347/23 |
| 6,388,758 | B2 * | 5/2002 | Kawanabe et al. | 358/1.13 |
| 7,029,090 | B2 | 4/2006 | Nishida et al. | |
| 2004/0257396 | A1 | 12/2004 | Nishida et al. | |

FOREIGN PATENT DOCUMENTS

| | | |
|---|---|---|
| EP | 0 525 988 A2 | 6/1992 |
| JP | 5-16391 | 1/1993 |
| JP | 06-122206 | 5/1994 |
| JP | 09-030008 | 2/1997 |
| JP | 10-193638 | 7/1998 |
| JP | 11-320912 | 11/1999 |
| JP | 2000-141686 | 5/2000 |
| JP | 2000-289229 | 10/2000 |
| JP | 2003-089226 | 3/2003 |
| JP | 2004-358791 | 12/2004 |
| JP | 2005-7866 | 1/2005 |

* cited by examiner

*Primary Examiner*—Stephen D Meier
*Assistant Examiner*—Alexander C Witkowski

(57) ABSTRACT

A cleaning mechanism for cleaning a print head in an inkjet printer with the print head having ink nozzles for discharging ink including a drive control unit which operates the cleaning mechanism at a first process level or a second process level that consumes less ink than the first process level; a timer which counts the elapsed time passed in which the print head is in a no-printing state; and a process selection unit responsive to a predetermined input cleaning command for selecting the first process level when the no-printing state has continued for less than a predetermined time or the second process level when the no-printing state has continued for greater than the predetermined time, based on the value of the timer when the predetermined input cleaning command is received. The predetermined input cleaning command can be received from a cleaning button or from a host computer. The drive control unit operates the cleaning mechanism at the process level selected by the process selection unit according to the predetermined input cleaning command.

17 Claims, 6 Drawing Sheets

CLEANING DEVICE, INKJET PRINTER, AND AN INKJET PRINTER CLEANING METHOD

BACKGROUND OF THE INVENTION

1. Field of the Invention

The present invention relates generally to an inkjet printer and to a cleaning device and method for cleaning the print head in an inkjet printer. The invention relates more particularly to a cleaning device and method for minimizing ink waste in an inkjet printer from cleaning processes executed in response to an operator command.

2. Description of Related Art

Inkjet printers print text and images on a print medium by discharging ink from the ink nozzles of a print head. Water is typically used as the ink solvent, and if ink is not discharged from the ink nozzles for a certain period of time, the water evaporates and the viscosity of the ink left in the nozzles increases. As a result, the nozzles clog, ink is not discharged or is not discharged at the normal size and speed, resulting in printing defects (referred to below as dropped dots). To prevent this, inkjet printers cover the nozzles with a cap when the print head is retracted to a standby position in order to prevent an increase in the viscosity of the ink in the nozzles.

However, simply covering the print head with a cap will not completely prevent the ink in the nozzles from increasing in viscosity when nothing is printed for an extended period of time. Depending on how the print head is used, dropped dots may also result from the ink meniscus inside the nozzles breaking during printing, such as when printing continues uninterrupted for a long time and the print head is repeatedly driven bidirectionally.

Inkjet printers therefore have a cleaning device for forcibly removing high viscosity ink inside the nozzles and restoring the ink meniscus. The cleaning device may drive an ink suction pump connected to the cap to vacuum ink for a predetermined time from all of the nozzles in a vacuum process, or discharge a very small amount of ink from all of the nozzles in a flushing process, or wipe the nozzle surface of the print head with a flexible blade in a wiping process, for example.

The vacuum process expels high viscosity ink and air bubbles from the nozzles (inside the ink path) and supplies new ink to the nozzles, and therefore effectively restores clogged nozzles. The flushing process effectively restores the ink meniscus, and wiping processes effectively remove contamination such as paper and ink waste adhering to the nozzle surface.

JP-A-2003-89226 teaches an inkjet printer that detects the nozzle condition, that is, whether the nozzles are clogged or whether ink is on the nozzle surface around the nozzles, and automatically executes the appropriate cleaning process according to the condition of the nozzles.

Other inkjet printers known from the literature automatically execute the appropriate cleaning process based on historical information, such as how much time has passed since the last cleaning process.

The vacuum process consumes a large amount of ink, and if the vacuum process is executed frequently by the automatic cleaning process, ink consumption rises accordingly and the cost of printing therefore rises. Conventional inkjet printers therefore set low frequency at which the vacuum process is executed by the automatic cleaning process, and provide a cleaning button enabling the operator to manually apply a cleaning process, including the vacuum process, if dots are dropped because the vacuum process has not been applied.

Many operators of inkjet printers that have a cleaning button and are unaccustomed to the printer often mistakenly operate the cleaning button when turning the printer power on, resulting in the vacuum process being frequently applied, thus increasing ink waste and increasing the cost of printing. This also increases the operating time of the ink vacuum pump, and can thus also shorten the service of the vacuum pump and other parts.

SUMMARY OF THE INVENTION

The present invention is directed to a cleaning device, an inkjet printer, and a cleaning method for an inkjet printer for suppressing ink waste by avoiding executing unnecessary vacuum discharge processes in print head cleaning operations executed in response to operator commands.

The cleaning device according to a first aspect of the invention comprises a cleaning mechanism for cleaning a print head having ink nozzles for discharging ink; a drive control unit for operating the cleaning mechanism at a first process level or a second process level that consumes less ink (including consuming no ink) than the first process level; a counter for counting time passed in a no-printing state in which a printing process is not executed by the print head; and a process selection unit for selecting the first process level when the no-printing state has continued for less than or equal to the predetermined time, and selecting the second process level when the no-printing state has continued for greater than the predetermined time, based on the value of the counter when a predetermined input is received; wherein the drive control unit operates the cleaning mechanism at the process level selected by the process selection unit according to the predetermined input.

The process selection unit receives a predetermined input signal representing a cleaning command from an operating member (cleaning button) of the cleaning device and/or a predetermined signal from a host computer (printer driver or application).

When a cleaning command is received from the operator after a predetermined period of time passes from the end of the last printing process, the cleaning mechanism is driven at the second process level in which ink consumption is low. Ink waste can therefore be suppressed.

Because the operator determines that cleaning is needed by looking at the printed output and noticing dropped dots, smudging, or other printing problems, the cleaning command should be asserted before a predetermined time passes after the end of the last printing process. Therefore, if the manual cleaning command from the operator is received after this predetermined time has passed since the end of the last printing process, the cleaning process was not requested because of the printed output, the likelihood of an operator error is high, and an actual cleaning process is probably not necessary.

The requested cleaning process is therefore determined to be unnecessary when the cleaning command considered is to be due to operator error, thus reducing ink waste and reducing the cost of printing. The ink cartridge replacement frequency can also be reduced. The service life of the ink suction pump and other cleaning parts can also be increased.

A cleaning device according to another aspect of the invention comprises a cleaning mechanism for cleaning a print head in response to a predetermined input with the print head having ink nozzles for discharging ink; a reporting unit for reporting that the cleaning mechanism will not clean the print head; a counter for counting time passed in a "no-printing state", hereinafter referred to as representing the state in which a printing process is not being executed by the print head; and a control unit for operating the cleaning mechanism when the no-printing state has continued for less than or equal to a predetermined time, and operating the reporting unit when the no-printing state has continued for greater than the predetermined time, based on the value of the counter when the predetermined input is received.

This aspect of the invention eliminates ink waste because the requested cleaning process is determined unnecessary and the reporting unit is operated instead of the cleaning mechanism if a cleaning command is received from the operator after the predetermined time has passed since the last printing process ended. The operator can also be aware that the cleaning process is unnecessary or the cleaning command was erroneously asserted (the cleaning command is inappropriate).

The counter is preferably set to a predetermined value greater than the predetermined time when the cleaning mechanism is operated (at a first process level), and is initialized and restarted when a printing process is executed by the print head.

If the operator applies a cleaning command before the next printing process executes (that is, before the counter is reset and restarts) after the cleaning mechanism operates at the first process level, this manual cleaning command is known to not follow a printing process because the counter is set to a value greater than the predetermined time (such as a maximum setting) even if the predetermined time has not passed since the last printing process ended. The cleaning mechanism is therefore driven at the second process level, and ink waste is reduced. Ink waste resulting from repeatedly running the cleaning process at the first process level can also be suppressed.

An inkjet printer that does not waste ink as a result of cleaning commands asserted by the operator can also be provided by rendering this cleaning device in an inkjet printer.

An inkjet printer cleaning method according to another aspect of the invention comprises the steps of (a) cleaning a print head at a first process level; (b) cleaning a print head at a second process level that consumes less ink (including consuming no ink) than the first process level; (c) counting time passed in a no-printing state in which a printing process is not executed by the print head; (d) receiving predetermined input; and (e) selectively executing step (a) or step (b) based on the time passed in the no-printing state when the predetermined input is received. The process selection step (e) selects the first cleaning step (a) when the no-printing state has continued for less than or equal to the predetermined time, and selects the second cleaning step (b) when the no-printing state has continued for greater than the predetermined time.

Preferably, step (d) receives a signal from an operating member of the inkjet printer and/or a signal from a host computer to which the inkjet printer is connected.

Further preferably, step (e) selects the second cleaning step (b) if the predetermined input is received before a printing process is executed by the print head after the first cleaning step (a) executes.

Further preferably, step (a) includes a vacuum discharge process of vacuuming (while discharging) a predetermined volume of ink from the ink nozzles of the print head, and step (b) includes a flushing process of discharging (a very small amount of) ink from the ink nozzles of the print head. Ink consumption by the second cleaning step can therefore be greatly reduced compared with the first cleaning step.

Yet further preferably, step (b) includes a wiping process of wiping the ink nozzle surface of the print head. Further preferably, step (b) includes a pump release process of releasing an ink suction pump for vacuuming ink from the ink nozzles of the print head. Further preferably, step (b) includes a dry suction process of vacuuming ink from a cap for covering the ink nozzles of the print head. Because ink is not discharged from the ink nozzles of the print head in these cases, ink waste can be eliminated in the second cleaning step. Furthermore, because the sound of the carriage movement accompanying the wiping process, and the sound of the pump mechanism operating in the pump release process or dry suction process, can be heard even though an actual cleaning process is not executing, the operator should not wrongly assume that the cleaning process is not executing and the printer is broken.

Yet further preferably, step (b) includes a display process of indicating that a cleaning process is not necessary (not performed). By not executing the cleaning process and instead causing a display indicator on the printer to light or displaying a message on the monitor of the host computer to inform the operator that the cleaning process is not needed, ink waste can be eliminated while also informing the operator that the cleaning process is not needed or that the manual cleaning command was the result of an operator error (that is, is inappropriate).

The cleaning method of the present invention can be provided as a control program that can be executed by the cleaning device or the control unit of the inkjet printer, and this control program can be provided recorded on a data recording medium.

Other advantages and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of a cleaning device and a cleaning method for an inkjet printer according to a preferred embodiment of the present invention are described below with reference to the accompanying figures.

Figure 1:
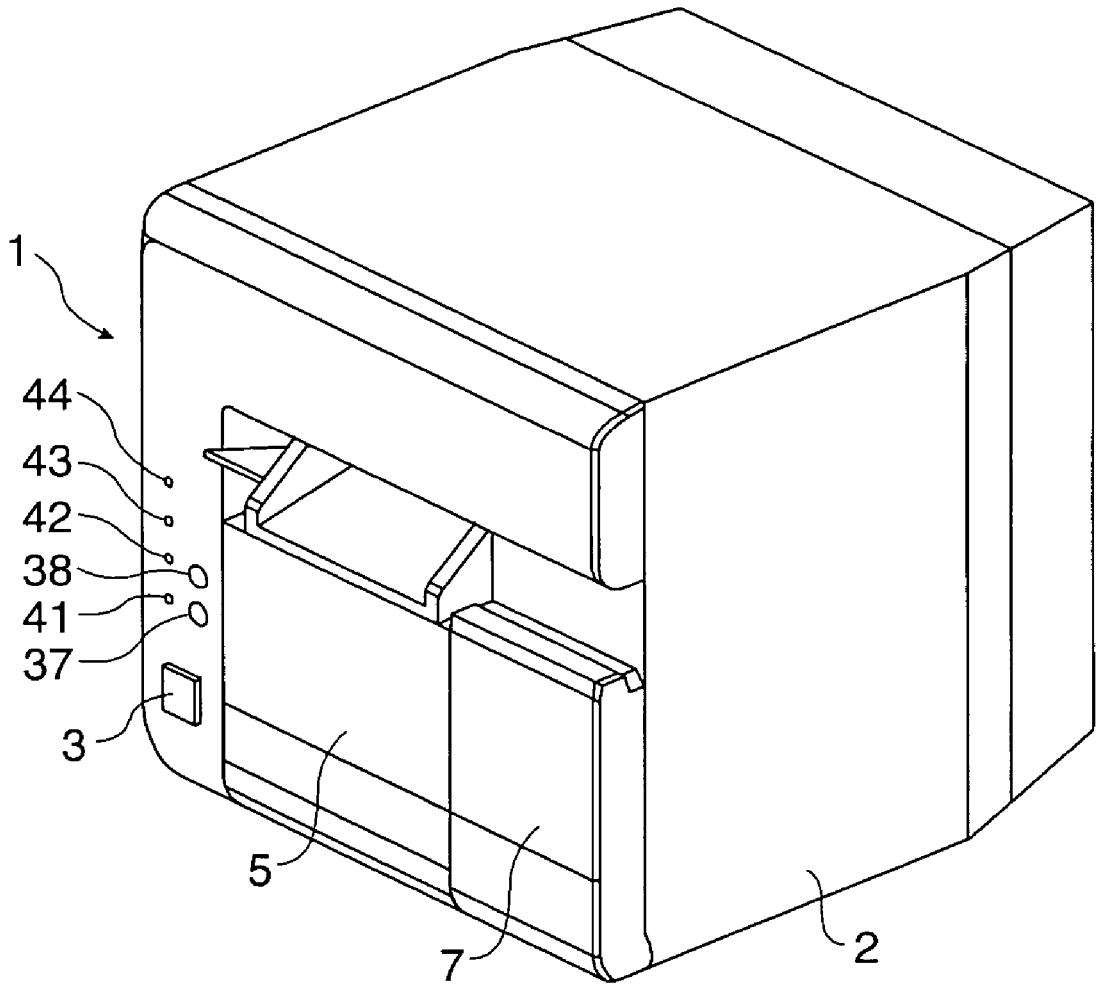
FIG. 1 is an external oblique view of an inkjet printer.

An inkjet printer 1 according to this embodiment of the invention prints to roll paper 11 using a plurality of colors of ink. As shown in FIG. 1, a roll paper cover 5 and ink cartridge cover 7 are disposed to the front of the case 2, and a power switch 3, cleaning button 37, feed switch 38, and four indicators 41 to 44 are disposed at the front left part of the case 2.

Figure 2:
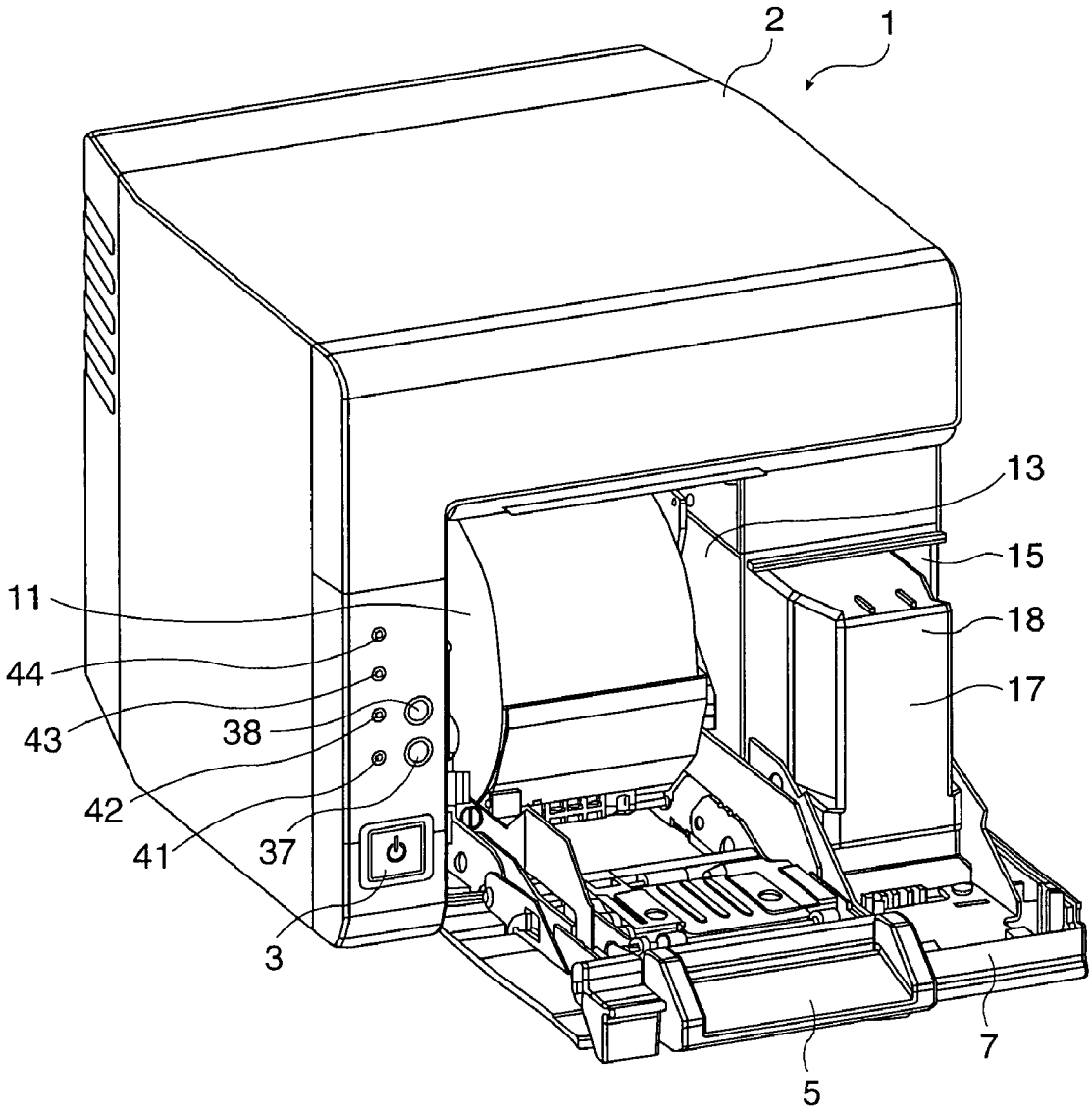
FIG. 2 is an oblique view of the inkjet printer with the roll paper cover and ink cartridge cover open.

As shown in FIG. 2, opening the roll paper cover 5 exposes the roll paper compartment 13 where the roll paper 11 is held, and thus enables loading and replacing the roll paper 11.

Figure 3:
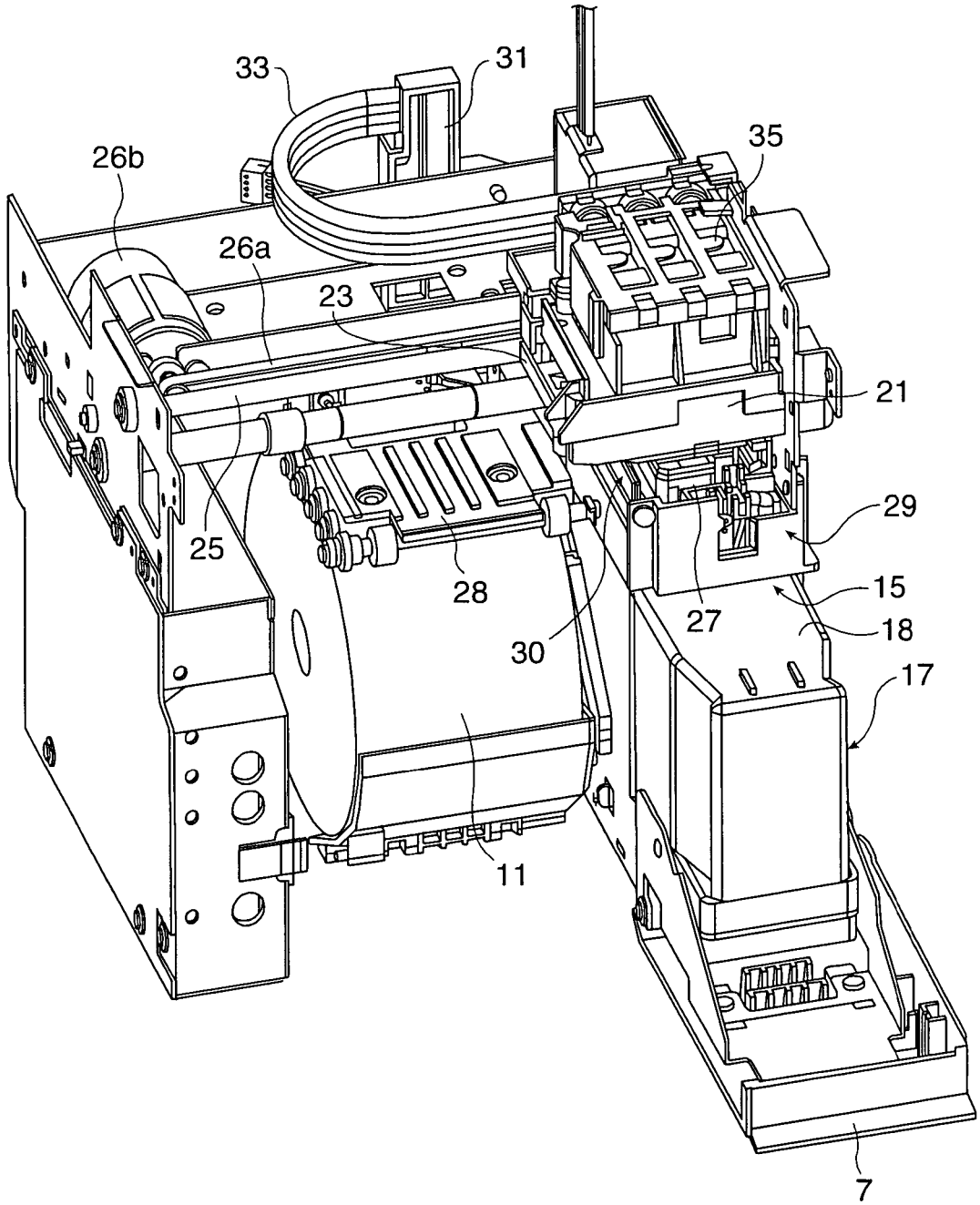
FIG. 3 is an oblique view of the inkjet printer with the printer case and roll paper cover removed.

As shown in FIG. 3, a carriage 23 carrying a print head 21 is disposed above the roll paper compartment 13. The carriage 23 is supported to move freely widthwise to the paper on a guide member 25 extending widthwise to the paper, and is linked to an endless belt **26*a* disposed widthwise to the paper between two pulleys. When the endless belt 26*a* is driven circularly by a carriage motor 26***b*, the carriage 23 travels bidirectionally widthwise to the paper along the guide member 25 above the platen 28.

The standby position (home position) of the carriage 23 is above the cartridge loading unit 15. Disposed near this standby position are a cap 27 for covering the ink nozzles of the print head 21 positioned on the bottom of the carriage 23, an ink suction mechanism 29 for vacuuming and disposing of ink from the inside of the print head 21 through the cap 27, and a wiping mechanism 30 for wiping the ink nozzle surface of the print head 21.

Opening the ink cartridge cover 7 reveals the cartridge loading unit 15 where the ink cartridge 17 is held, and thus enables loading and removing the ink cartridge 17. In the inkjet printer 1 according to this embodiment of the invention opening the ink cartridge cover 7 also pulls the ink cartridge 17 out a predetermined distance to the front of the cartridge loading unit 15. The ink cartridge 17 stores a plurality of colors of ink packs inside the cartridge case 18.

When loading an ink cartridge 17 into the cartridge loading unit 15, ink supply needles disposed to the cartridge loading unit 15 are inserted to and connect with the ink supply opening in each ink pack. The ink supply needles are connected to a stationary ink path 31 in the case 2, and one end of a flexible ink tube 33 is connected to the ink path 31. The other end of the ink tube 33 is connected to each ink nozzle of the print head 21 through a back pressure adjusting unit 35 disposed to the print head 21. Ink in each ink pack inside the ink cartridge 17 therefore flows from the ink supply needles of the cartridge loading unit 15 through the ink path 31, ink tube 33, and back pressure adjusting unit 35 to each ink nozzle of the print head 21.

The cleaning button 37 at the front of the case 2 enables the operator to tell the inkjet printer 1 to run the print head cleaning process when a problem occurs, such as the ink nozzles of the print head 21 become clogged. One of the four indicators 41 to 44, specifically the bottom indicator 41 (reporting unit) in this embodiment of the invention, is used to inform the operator that the cleaning button 37 was operated in error (that is, that the cleaning process will run).

Operator cleaning commands can also be applied from the printer driver that runs on a host computer 80 and controls the inkjet printer 1. The printer driver for an inkjet printer generally has a print head cleaning function as a utility function, and the operator can issue cleaning commands through the graphical user interface (GUI) of the printer driver.

Figure 4:
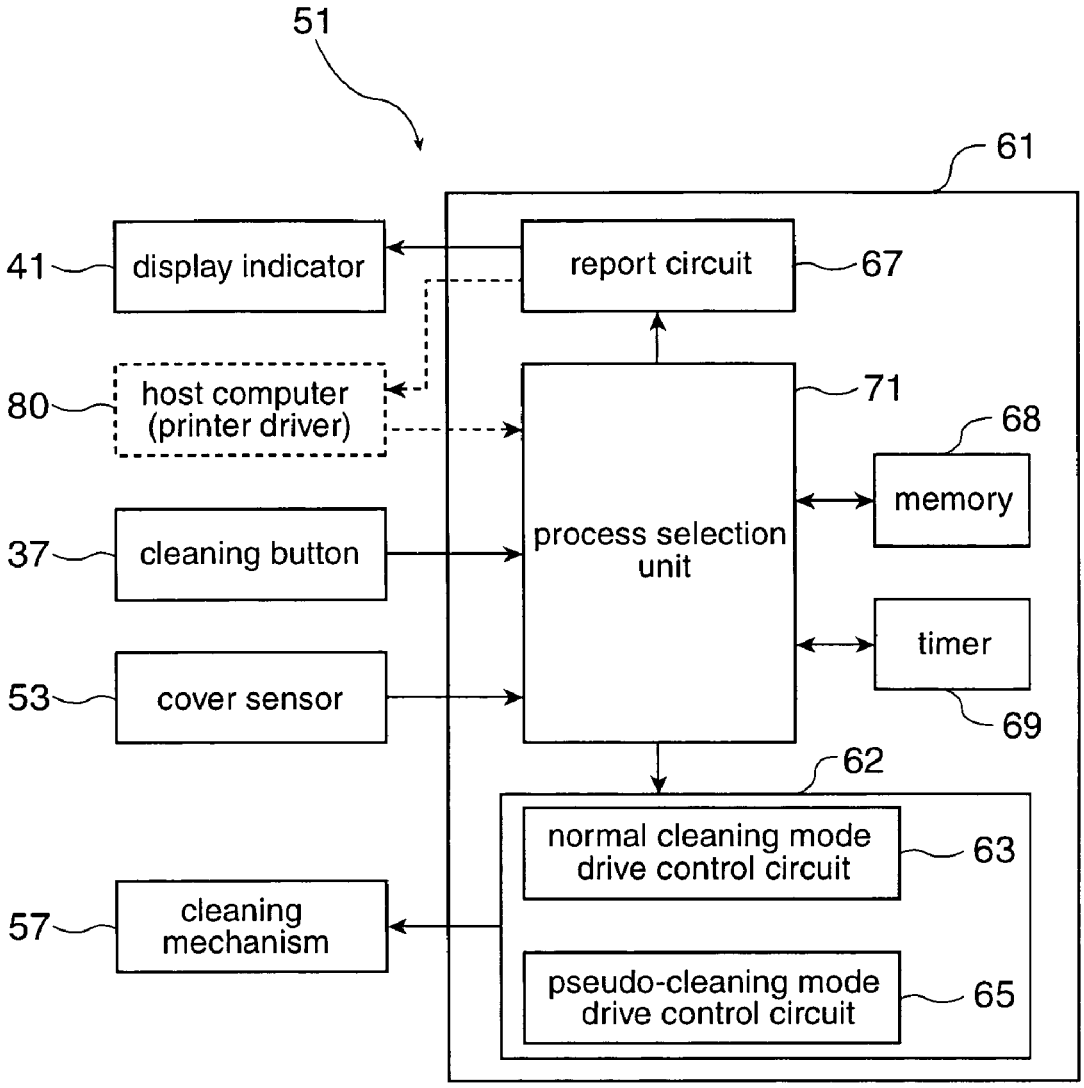
FIG. 4 is a block diagram of the cleaning device.

The inkjet printer 1 also has a cleaning device 51 as shown in FIG. 4. The cleaning device 51 runs a print head cleaning process to prevent dropped dots and other print defects caused by increased viscosity in the ink remaining in the ink nozzles of the print head 21, ink nozzle clogging caused by increased ink viscosity, or a broken ink meniscus.

The cleaning device 51 has a cover sensor 53 for detecting if the roll paper cover 5 and ink cartridge cover 7 are open or closed, a cleaning button 37 which when pressed outputs a specific signal, a cleaning mechanism 57, a display indicator 41 that flashes or lights steady to report an error, and a control unit 61 for controlling operation of the cleaning mechanism 57 and display indicator 41 based on output signals from the cover sensor 53, cleaning button 37, and host computer 80.

The cleaning mechanism 57 comprises an ink suction mechanism 29 for vacuuming ink from the ink nozzles by means of an ink suction pump, a wiping mechanism 30 for wiping the ends of the ink nozzles (the nozzle surface) with a wiper blade, and a flushing mechanism for discharging a very small quantity of ink from all of the ink nozzles.

The control unit 61 comprises a drive control unit 62, a report circuit 67 for driving the display indicator 41 or sending an error report to the host computer 80, memory 68 for recording a print head cleaning process history or other information, a timer 69 (counter) for counting the time elapsed since the last cleaning process ended, and a process selection unit 71 for selectively operating the normal cleaning mode drive control circuit 63, pseudo-cleaning mode drive control circuit 65, or report circuit 67.

The drive control unit 62 comprises a normal cleaning mode drive control circuit 63 that causes the cleaning mechanism 57 to operate in the normal cleaning mode, and a pseudo-cleaning mode drive control circuit 65 for driving the cleaning mechanism 57 in a pseudo-cleaning mode.

The process selection unit 71 monitors the output signals from the cover sensor 53, cleaning button 37, and host computer 80, and information from the memory 68 and timer 69, determines if these signals and information meet predetermined conditions, and selectively drives the normal cleaning mode drive control circuit 63, pseudo-cleaning mode drive control circuit 65, or report circuit 67 based on the matching conditions. The timer 69 is initialized and restarts every time a cleaning process ends.

The cleaning process in the normal cleaning mode controlled by the normal cleaning mode drive control circuit 63 executes specific cleaning operations such as a vacuum discharge process for driving the ink suction pump of the ink suction mechanism 29 to vacuum while discharging a specific volume of ink from the ink nozzles of the print head 21, and a wiping process to wipe the nozzle surface after the vacuum discharge process as may additionally be required. The amount of ink vacuumed in the vacuum discharge process is controlled in multiple levels to discharge and vacuum a quantity of ink appropriate to how badly the ink nozzles are clogged, for example. A flushing process is also executed to discharge a large volume of ink from the ink nozzles because a mixture of ink of different colors typically adheres to and around the ink nozzles after the vacuum discharge process.

The cleaning process in the pseudo-cleaning mode executed by the pseudo-cleaning mode drive control circuit 65 executes a flushing process that discharges a very small quantity of ink from all ink nozzles without executing the vacuum discharge process of the ink suction mechanism 29. Ink consumption is therefore reduced compared with the normal cleaning mode executed by the normal cleaning mode drive control circuit 63. While the cleaning process consumes approximately 0.84 gram to approximately 4.8 grams (depending on the cleaning level) in the normal cleaning mode, ink consumption in the cleaning process of the pseudo-cleaning mode is only approximately 0.01 gram, and ink consumption can thus be greatly reduced.

The cleaning process executed by the cleaning device 51 is described next. The cleaning process includes an automatic cleaning process and a manual cleaning process. The automatic cleaning process executes automatically when print head 21 usage reaches specific predetermined conditions based on such data as the time passed since the last cleaning process ended, and how much ink was discharged from each ink nozzle during that time (that is, the printing volume). The manual cleaning process is manually started by the operator when, for example, the operator notices dropped dots, smudged printing, or other defects in the printed output.

The automatic cleaning process is described below with reference to the flow chart in FIG. 5.

When the automatic cleaning process starts, the carriage 23 is released from the carriage stop position (S101) and moved slowly to the home position (S102). Whether the roll paper cover 5 or ink cartridge cover 7 is open is then determined based on the output signal from the cover sensor 53 (S103). If either cover is open (S103 returns Yes), an open cover state is reported by means of display indicator 42, for example (S104).

If both covers are closed (S103 returns No), the process selection unit 71 starts the cleaning process of the normal cleaning mode executed by the normal cleaning mode drive control circuit 63, and a cleaning process including the vacuum discharge process of the ink suction mechanism 29 is applied to the print head 21 resting at the home position (S105).

When the cleaning process ends, the time when the cleaning process ended is stored as the last cleaning process time in memory 68 (S106), and the timer 69 is set to the maximum setting (S107). The carriage 23 is then locked in the home position (S108), and the cleaning process ends.

Figure 6:
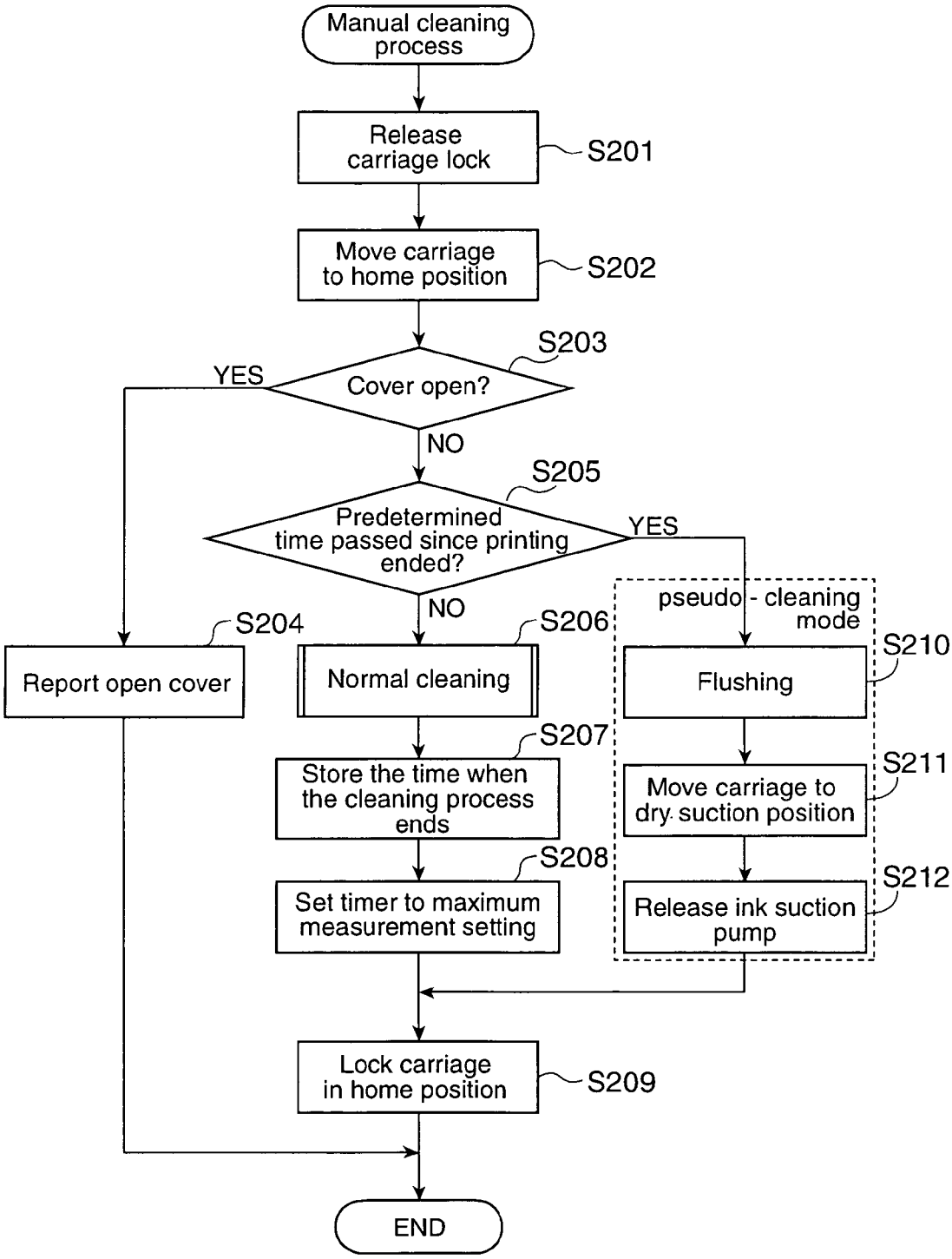
FIG. 6 is a flow chart of the manual cleaning process.

FIG. 6 is a flow chart describing the manual cleaning process. A command initiating the manual cleaning process is applied by means of the cleaning button 37 or printer driver (host computer 80), and the command is received by the control unit 61 (process selection unit 71).

When a manual cleaning command is asserted, a process identical to the steps S101 to S104 of the automatic cleaning process is executed (S201 to S204). If in step S203 it is determined that both covers are closed (S203 returns No), whether a predetermined time (such as one hour) has passed between when the last cleaning process ended and the manual cleaning command was asserted is determined based on the current value of the timer 69. If this predetermined time has not passed (S205 returns No), the process selection unit 71 runs the cleaning process of the normal cleaning mode by means of the normal cleaning mode drive control circuit 63 (steps S105 to S107 shown in FIG. 5) (S206 to S208), locks the carriage in the home position (S209), and ends the cleaning process.

If the predetermined time passed between when the last cleaning process ended and the cleaning button 37 was operated (S205 returns Yes), the process selection unit 71 starts the cleaning process in the pseudo-cleaning mode by means of the pseudo-cleaning mode drive control circuit 65. This pseudo-cleaning mode process applies a light cleaning process using a flushing process in which a very small amount of ink is discharged from each ink nozzle of the print head 21 in the home position (S210).

The carriage 23 is then moved slowly to a dry suction position offset to the side from the home position (S211). In this dry suction position the print head 21 is offset from directly above the cap 27.

The ink suction pump of the ink suction mechanism 29 is then released (S212). A tube pump that uses a roller to sequentially crimp the flexible ink tube 33 to create negative pressure is used as the ink suction pump in an inkjet printer 1 according to this embodiment of the invention. A tube pump has a pumping mode in which the pump drive motor rotates forward so that the roller rolls while compressing the ink tube 33, and a release mode in which the pump drive motor reverses to remove the roller from the ink tube 33.

This pump release step (S212) is purposely designed to enable the operator to know from the sound of a mechanical action that the cleaning process is executing. If no operating noise is heard even though the cleaning button 37 is operated, the operator may press the cleaning button 37 again as a result of mistakenly thinking that the cleaning button 37 was not actuated, and this operating noise therefore prevents the operator from thinking that the cleaning button 37 or the inkjet printer 1 is broken.

The carriage 23 is then returned slowly to the home position and locked (S209) to end the cleaning process.

The pseudo-cleaning process may execute the wiping process to wipe the nozzle surface of the print head 21 with a wiper blade in addition to or instead of the vacuuming operation described in steps S210 to S212. A dry pumping process for removing ink held in the ink sponge of the cap 27 can also be executed by driving the ink suction pump of the ink suction mechanism 29 for a predetermined time (a shorter time than in the vacuum discharge process in the normal cleaning mode) when the carriage 23 is in the dry suction position.

Further alternatively, instead of executing the pseudo-cleaning process, the process selection unit 71 can drive the report circuit 67 to inform the user that the manual cleaning process will not be executed (that is, that the cleaning process is not needed). The display indicator 41 can be driven to light steady if the manual cleaning command is asserted using the cleaning button 37, or a corresponding signal can be sent to the host computer 80 if the command is asserted from the host computer 80, for example.

When a manual cleaning command is asserted and a printing process was not executed during a predetermined time before the manual cleaning command was asserted, the cleaning process of a pseudo-cleaning mode is executed by the inkjet printer cleaning device and cleaning method of the present invention. Manual cleaning commands asserted by the cleaning button 37 or from the host computer 80 are normally input when the operator sees the printed output and decides that cleaning is necessary due to dropped dots or smeared printing, for example, and such commands are therefore typically asserted before a predetermined time has passed since the end of the previous printing process. That is, if a printing process has not run within a predetermined time before the manual cleaning command is asserted, the likelihood that the command was asserted due to operator error is high, and it is possible to determine that a cleaning process to actually clean the print head 21 is not necessary. As a result, the cleaning process of a pseudo-cleaning mode that consumes little ink is applied instead of the cleaning process of the normal cleaning mode that consumes a large quantity of ink.

The cost of printing can therefore be reduced by preventing unnecessary vacuum discharge processes and eliminating ink waste when the cleaning button 37 is mistakenly operated multiple times by an operator unfamiliar with the printer. Using the printer is also more user friendly because the frequency of replacing the ink cartridge 17 is reduced. The ink suction pump operating time is also reduced, and the service life of the ink suction pump is therefore longer.

Figure 5:
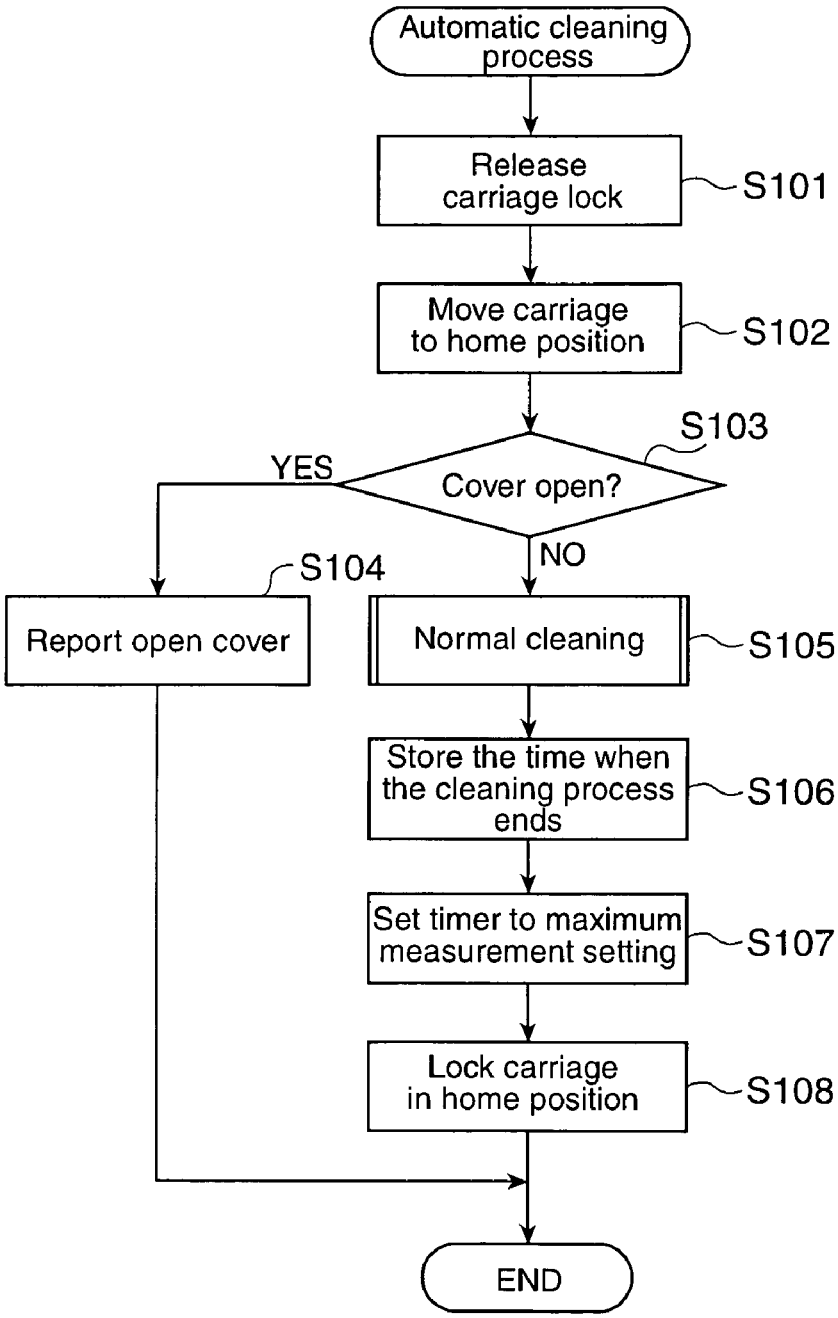
FIG. 5 is a flow chart of the automatic cleaning process.

The timer 69 is set to a value greater than the predetermined time (such as a maximum time) (S107, S208) after the normal cleaning process (S105, S206) as shown in FIG. 5. If the manual cleaning process is executed in response to an operator command before anything is printed after the normal cleaning process runs, step S205 determines that the predetermined time has already passed and the pseudo-cleaning process is executed even if the time since the last printing process ended is actually less than the predetermined time.

Furthermore, because the timer 69 is initialized and restarted after the printing process when a printing process is executed after the normal cleaning process, the normal cleaning process is executed if the operator asserts the manual cleaning command within the predetermined time after the printing process ends.

The cleaning device 51 and cleaning method of the inkjet printer 1 according to this embodiment of the invention can thus reduce ink waste due to unnecessary cleaning processes that are manually initiated (from an external command) without being accompanied by a printing operation.

The present invention is not limited to the inkjet printer 1 described above, and can be applied to any type of inkjet printer (including printers that print to single sheet paper and inkjet printers using different types of ink cartridges) that enables the operator to manually initiate a print head cleaning process.

Furthermore, the drive control circuits 63, 65 that drive the cleaning mechanism 57 can be combined in a common circuit, and a control program for driving this common circuit can be rendered to selectively drive the cleaning mechanism 57 in the normal cleaning mode or the pseudo-cleaning mode.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cleaning device for a printer comprising:

a cleaning mechanism for cleaning a print head having ink nozzles for discharging ink;

a drive control unit for operating the cleaning mechanism at a first level of cleaning using a vacuum discharge process for driving an ink suction pump to vacuum and discharge ink from the ink nozzles in an amount corresponding to the consumption of a given volume of ink or at a second level of cleaning representing a pseudo-cleaning mode that executes a flushing process instead of a vacuum discharge process for discharging a volume of ink from the ink nozzles equal to an amount less than at least 1.5 orders of magnitude smaller than the volume of ink discharged in the first level of cleaning;

a counter for counting an elapsed time in which the print head is in a no-printing state; and a process selection unit responsive to a predetermined input thereto for making a selection of the first level of cleaning when the no-printing state has continued for less than or equal to a predetermined time or the second level of cleaning when the no-printing state has continued for greater than the predetermined time, based on the value of the counter when the predetermined input is received;

wherein the drive control unit operates the cleaning mechanism at the level of cleaning selected by the process selection unit according to the predetermined input.

2. The cleaning device of claim 1, wherein:

the counter is set to a value greater than the predetermined time when the cleaning mechanism is operated at the first level of cleaning, and is initialized and restarted when a printing process is executed by the print head.

3. The cleaning device of claim 1, wherein:

the predetermined input is a signal from an operating member of the cleaning device and/or a signal from a host computer.

4. The cleaning device of claim 1 further comprising:

a reporting unit for reporting that the cleaning mechanism will not clean the print head;

and a control unit for operating the cleaning mechanism in response to a predetermined input when the no-printing state has continued for less than or equal to a predetermined time, and operating the reporting unit when the no-printing state has continued for greater than the predetermined time, based on the value of the counter when the predetermined input is received.

5. The cleaning device of claim 4, wherein:

the counter is set to a predetermined value greater than the predetermined time when the cleaning mechanism is operated, and is initialized and restarted when a printing process is executed by the print head.

6. The cleaning device of claim 4, wherein:

the predetermined input is a signal from an operating member of the cleaning device and/or a signal from a host computer.

7. An inkjet printer having a print head with ink nozzles for discharging ink comprising:

a cleaning mechanism for cleaning the print head;

a drive control unit for operating the cleaning mechanism at a first level of cleaning using a vacuum discharge process for driving an ink suction pump to vacuum and discharge ink from the ink nozzles in an amount corresponding to the consumption of a given volume of ink or at a second level of cleaning representing a pseudo-cleaning mode that executes a flushing process instead of a vacuum discharge process for discharging a volume of ink from the ink nozzles equal to an amount of less than at least 1.5 orders of magnitude smaller than the volume of ink discharged in the first level of cleaning;

a counter for counting an elapsed time in which the print head is in a no-printing state; and a process selection unit responsive to a predetermined input for making a selection of the first level of cleaning when the no-printing state has continued for less than or equal to a predetermined time or the second level of cleaning when the no-printing state has continued for greater than the predetermined time, based on the value of the counter when the predetermined input is received;

wherein the drive control unit operates the cleaning mechanism at the level of cleaning selected by the process selection unit according to the predetermined input.

8. The cleaning device of claim 7 further comprising:

a reporting unit for reporting that the cleaning mechanism will not clean the print head;

and a control unit for operating the cleaning mechanism in response to a predetermined input when the no-printing state has continued for less than or equal to a predetermined time, and operating the reporting unit when the no-printing state has continued for greater than the predetermined time, based on the value of the counter when the predetermined input is received.

9. A cleaning method for cleaning a print head in an inkjet printer in response to a predetermined input comprising the steps of:

(a) cleaning the print head in a normal cleaning mode using an automatic cleaning operation at a first level of cleaning in which a given volume of ink is consumed;

(b) cleaning the print head following a manual cleaning command either using the cleaning process in the normal cleaning mode of step (a) or using a pseudo-cleaning mode at a second level of cleaning that executes a flushing process instead of a vacuum discharge process for discharging a volume of ink from ink nozzles equal to an amount of less than at least 1.5 orders of magnitude smaller than the volume of ink discharged in the first level of cleaning;

(c) counting an elapsed time passed in which the print head is in a no printing state; and (d) selectively executing step (a) or step (b) based on the time passed in the no-printing state in response to a predetermined input, wherein step (d) selects step (a) when the no-printing state has continued for less than or equal to the predetermined time, and selects step (b) when the no-printing state has continued for greater than the predetermined time.

10. The cleaning method of claim 9, wherein:

the predetermined input is a signal from an operating member of the printer and/or a signal from a host computer to which the inkjet printer is connected.

11. The cleaning method of claim 9, wherein:

step (d) selects step (b) if the predetermined input is received before a printing process is executed by the print head after step (a) executes.

12. The cleaning method of claim 9, wherein:

step (a) includes a vacuum discharge process of vacuuming a predetermined volume of ink from the ink nozzles of the print head.

13. The cleaning method of claim 9, wherein:

step (b) includes a flushing process of discharging ink from the ink nozzles of the print head.

14. The cleaning method of claim 9, wherein:

step (b) includes a wiping process of wiping the ink nozzle surface of the print head.

15. The cleaning method of claim 9, wherein:

step (b) includes a pump release process of releasing an ink suction pump for vacuuming ink from the ink nozzles of the print head.

16. The cleaning method of claim 9, wherein:

step (b) includes a dry suction process of vacuuming ink from a cap for covering the ink nozzles of the print head.

17. The cleaning method of claim 9, wherein:

step (b) includes a display process of indicating that a cleaning process is not necessary.

* * * * *